US005772956A

United States Patent [19]

Hasegawa et al.

[11] Patent Number: 5,772,956

[45] Date of Patent: Jun. 30, 1998

[54] HIGH STRENGTH, FERRITIC HEAT-RESISTANT STEEL HAVING IMPROVED RESISTANCE TO INTERMETALLIC COMPOUND PRECIPITATION-INDUCED EMBRITTLEMENT

[75] Inventors: Yasushi Hasegawa; Masahiro Ohgami; Hisashi Naoi, all of Futtsu, Japan

[73] Assignee: Nippon Steel Corporation, Tokyo, Japan

[21] Appl. No.: 722,057

[22] PCT Filed: Feb. 14, 1996

[86] PCT No.: PCT/JP96/00319

§ 371 Date: Oct. 11, 1996

§ 102(e) Date: Oct. 11, 1996

[87] PCT Pub. No.: WO96/25530

PCT Pub. Date: Aug. 22, 1996

[30] Foreign Application Priority Data

Feb. 14, 1995 [JP] Japan ..... 7-025738

[51] Int. Cl.[6] ..... C22C 38/22; C22C 38/30

[52] U.S. Cl. ..... 420/40; 420/41; 420/69; 148/325

[58] Field of Search ..... 420/40, 41, 69; 148/325

[56] References Cited

U.S. PATENT DOCUMENTS

| | | | |
|---|---|---|---|
| 4,957,701 | 9/1990 | Masuyama et al. | 420/69 |
| 5,069,870 | 12/1991 | Iseda et al. | 420/69 |
| 5,413,754 | 5/1995 | Yazawa et al. | 420/41 |

FOREIGN PATENT DOCUMENTS

| | | |
|---|---|---|
| 53-61514 | 6/1978 | Japan . |
| 60-224754 | 11/1985 | Japan . |
| 61-69948 | 4/1986 | Japan . |
| 63-89644 | 4/1988 | Japan . |
| 2-290950 | 11/1990 | Japan . |
| 4-268044 | 9/1992 | Japan . |
| 4-371552 | 12/1992 | Japan . |

*Primary Examiner*—Deborah Yee
*Attorney, Agent, or Firm*—Kenyon & Kenyon

[57] ABSTRACT

A martensitic heat resistant steel is provided which has improved high temperature creep strength, contains Co and, at a temperature of 600° C. or above, does not form an intermetallic compound substantially having a composition of $Cr_{40}Mo_{20}Co_{20}W_{10}C_2$—Fe. In a heat-resistant steel, containing not less than 8% of Cr, with Co, Mo, and W being simultaneously added thereto, a combination of the addition of a very small of Mg, Ba, Ca, Y, Ce, La and the like, with the addition of a minor amount of Ti and Zr, inhibits the precipitation of an intermetallic compound substantially having a composition of $Cr_{40}Mo_{20}Co_{20}W_{10}C_2$—Fe, thereby ensuring high temperature creep strength.

4 Claims, 6 Drawing Sheets

HIGH STRENGTH, FERRITIC HEAT-RESISTANT STEEL HAVING IMPROVED RESISTANCE TO INTERMETALLIC COMPOUND PRECIPITATION-INDUCED EMBRITTLEMENT

TECHNICAL FIELD

The present invention relates to a ferritic heat-resistant steel. More particularly, the present invention relates to a ferritic heat-resistant steel for use in high temperature and high pressure environments, which has improved creep rupture strength and improved resistance to intermetallic compound precipitation-induced embrittlement.

BACKGROUND ART

In recent years, there has been a tendency for thermal power generation boilers to be operated under higher temperature and higher pressure conditions and operation under conditions of 566° C. and 316 bar is planed. In the future, operation at temperatures up to 649° C. and pressures up to 352 bar is expected. In this case, the materials used will be exposed to very severe conditions.

Heat resistant materials used in thermal power plants are exposed to different environments depending upon the sites where the materials are used. For sites where the temperature of the atmosphere is high, such as the so-called "superheater tube" and "reheater tube," austenitic materials having particularly improved corrosion resistance and strength at high temperatures, or 9–12% Cr-containing martensitic materials, when steam oxidation resistance and thermal conductivity are taken into consideration, have been used in many cases.

In recent years, novel heat resistant materials, to which W has been added in order to improve the high temperature strength, have been researched and developed and put into practical use, greatly contributing to an increase in efficiency of power generation plants. Japanese Unexamined Patent Publications (Kokai) No. 63-89644, No. 61-231139, and No. 62-297435 disclose ferritic heat resistant steels which, by taking advantage of W as a solid solution strengthening element, provide much higher creep strength than the conventional ferritic heat resistant steel with Mo added thereto. In many cases, these materials have a single phase structure of tempered martensite, and, by virtue of superior steam oxidation resistance of the ferritic steel in combination with high strength properties, are expected to be used as advanced materials for use under high temperature and high pressure environments. For example, Japanese Unexamined Patent Publications (Kokai) No. 5-263196, No. 5-311342, No. 5-311343, No. 5-311344, No. 5-311345, and No. 5-311346 disclose 12% Cr steels having improved high temperature creep strength.

The high temperature strength of ferritic heat resistant steels is governed by solid solution strengthening and precipitation strengthening. According to recent techniques, incorporation of the solid solution strengthening and precipitation strengthening in a well balanced manner could successfully increase the high temperature creep strength, and it has been confirmed that W and Mo are useful for solid solution strengthening, while Nb and V and carbides or nitrides thereof are useful to increase creep rupture strength by utilizing precipitation strengthening. The only practical problem of these additive elements useful for increase in strength is that, since all the additive elements are ferrite stabilizers, they enhance the Cr equivalent of the material, resulting in the formation of a dual phase structure of delta ferrite-tempered martensite rather than a single phase structure of martensite. The dual phase structure has properties different from the single phase structure, and, when homogeneous properties are required as material properties, the use thereof is avoided in many cases. Further, interphase partition or distribution of individual elements occurs, posing a problem in the case of materials having unsatisfactory corrosion resistance.

For this reason, among the ferritic heat resistant steels, those wherein high strength is attained by providing a tempered martensitic structure are required to have a single phase structure. For this reason, it is common practice to conduct constituent design in such a manner that a certain amount of an austenite stabilizer is added as a constituent to the material to form a single phase structure of martensite upon cooling after solution treatment.

Austenite stabilizers usable for the above purpose include Ni, Mn, Co, Cu, C, and N. When importance is given to high temperature creep strength, Ni and Mn are excluded from the candidate elements for reasons of induction of lowered creep strength, while when the weldability should be ensured, Cu is excluded. C and N markedly change the mechanical properties of the material, and, hence, the design of addition thereof is, in many cases, determined by taking into consideration the balance between the strength and the toughness of the material. In many cases, this makes it impossible to use C and N for positively creating the single phase structure of martensite. Therefore, after all, Co which does not greatly influence other mechanical properties, despite its high price, is selected and is being used in recent ferritic heat resistant steels.

The present inventors have aimed at the novel ferritic heat resistant steels composed mainly of W, Mo, and Co and continued to study these steels and, as a result, have found that, in a creep rupture test at a temperature of 600° C. or above, a steel, containing not less than 8% of Cr, with Co, Mo, and W being simultaneously added thereto, when the test time exceeds $10^4$ hr, causes, depending upon chemical composition and heat treatment conditions, the precipitation of an intermetallic compound (estimated to be subspecies of ASTM card No. 23-196) substantially having a composition of $Cr_{40}Mo_{20}Co_{20}W_{10}C_2$—Fe, which has not been observed in the conventional ferritic heat resistant steels, at grain boundaries of the steel. It has been found that this intermetallic compound is precipitated in a Cr steel, with Co, W, and Mo being added in combination, under actual service conditions; that the intermetallic compound is precipitated in a film form; and that, in some cases, it is rapidly grown along the grain boundaries to a size exceeding 50 $\mu$m.

Further, it has been found that the material with the intermetallic compound being precipitated causes an about a 30% decrease in creep rupture strength in terms of $10^5$-hr linear-extrapolated rupture strength and, when subjected to a toughness test after aging, causes about 40° C. rise in the fracture appearance transition temperature.

Therefore, the results of this study have revealed that it is difficult to use the high strength and heat resistant steel, containing not less than 8% Cr, with Co, Mo, and W being added in combination, under severe environment of 650° C. and 350 atm, unless a technique which can prevent the precipitation of the intermetallic compound is developed.

As a result of further studies conducted by the present inventors, it has been found that the addition of the above elements simultaneously with the addition of a very small amount of Mg, Ba Ca, Y, Ce, La and the like which have hitherto been added as a desulfurizer in order to fix S contained in the steel, the precipitation of the intermetallic compound in a film form can be inhibited by about 70% and that the addition of a minor amount of Ti and Zr among strong carbide formers causes fixation of C contained in a very small amount in the intermetallic compound, resulting in change of properties of the intermetallic compound, which in turn causes the intermetallic compound to be spheroidized even in the case of precipitation of the intermetallic compound in a small amount. It is difficult to completely prevent the precipitation of the intermetallic compound without use of both the above techniques in combination, and, when any one of the techniques is used, an about 20% lowering in creep rupture strength and a 20° C. rise in fracture appearance transition temperature cannot be avoided.

DISCLOSURE OF INVENTION

An object of the present invention is to provide a novel ferritic heat resistant steel, having a Co-containing single phase structure of martensite, which can eliminate the drawback of the above conventional steels, that is, can prevent the precipitation of an intermetallic compound substantially having a composition of $Cr_{40}Mo_{20}Co_{20}W_{10}C_2$—Fe, has satisfactory corrosion resistance despite the incorporation of 8 to 13% of Cr and has high creep rupture strength despite the incorporation of Mo and W.

In order to attain the above object, the present invention provides a high strength, ferritic heat resistant steel having improved resistance to intermetallic compound precipitation-induced embrittlement, characterized by comprising, by mass:

C: 0.01 to 0.30%, Si: 0.01 to 0.80%,

Mn: 0.20 to 1.50%, Cr: 8.00 to 13.00%,

Mo: 0.01 to 3.00%, W: 0.10 to 5.00%,

Co: 0.05 to 6.00%, V: 0.002 to 0.800%,

Nb: 0.002 to 0.500%, and

N: 0.002 to 0.200% and at least one additional element selected from

Ca: 0.0005 to 0.0050%, Ba: 0.0003 to 0.0020%,

Mg: 0.0005 to 0.0050%, La: 0.001 to 0.020%,

Ce: 0.001 to 0.020%, and

Y: 0.001 to 0.020%, said Ca, Ba, and Mg being contained as precipitate, said La, Ce, and Y being contained as precipitate or in solid solution, said steel further comprising one of or a combination of Ti: 0.002 to 0.500% and Zr: 0.002 to 0.500, and optionally further comprising, either alone or in combination, Ni: 0.10 to 2.00% and Cu: 0.10 to 2.00%, and optionally further comprising B: 0.0005 to 0.010%, said steel having P, S, and O contents limited to P: not more than 0.030%, S: not more than 0.010%, and O: not more than 0.020%, with the balance consisting of Fe and unavoidable impurities.

BEST MODE FOR CARRYING OUT THE INVENTION

Figure 1:
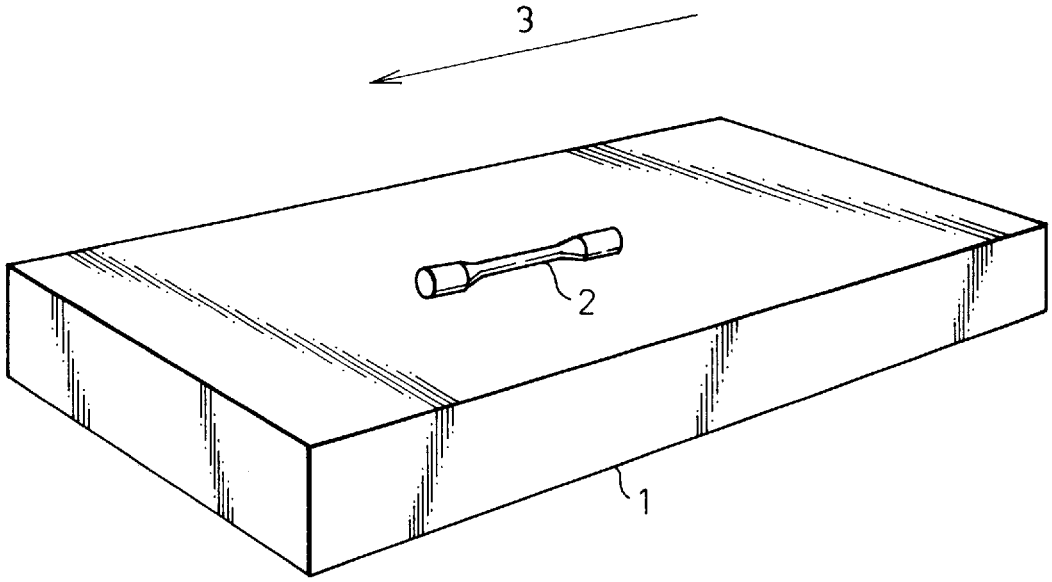
FIG. 1 is a perspective view showing a test piece and the rolling direction of a steel plate and the direction of extraction of a test piece for the evaluation of the creep rupture strength.

The reasons for the limitation of chemical compositions of a steel in the present invention will be described.

C is necessary for ensuring the strength. A C content of less than 0.01% is unsatisfactory for ensuring the strength. On the other hand, when the C content exceeds 0.30%, the weld heat affected zone is markedly hardened, which is causative of cold cracking at the time of welding. For this reason, the C content is limited to 0.01 to 0.30. C is present in a very small amount also in a harmful intermetallic compound. However, there is no correlation between the amount of C added and the conditions for precipitation of the intermetallic compound.

Si is important for ensuring the oxidation resistance and, at the same time, is necessary as a deoxidizer. A Si content of less than 0.01% is unsatisfactory for attaining the contemplated effects, while when the Si content exceeds 0.80%, the creep strength is lowered. Therefore, the Si content is limited to 0.02 to 0.80%.

Mn is an element which is necessary not only for deoxidization but also for ensuring the strength. The addition of Mn in an amount of not less than 0.20% is necessary for attaining satisfactory effect. When the Mn content exceeds 1.50%, the creep strength is often deteriorated. For the above reason, the Mn content is limited to 0.20 to 1.50%.

Cr is an element which is indispensable to the oxidation resistance and, at the same time, combines with C to form $Cr_{23}C_6$, $Cr_7C_3$ or the like which is finely precipitated in the matrix of the base material, contributing to an increase in creep strength. The lower limit of the Cr content is 8.00% from the viewpoint of the oxidation resistance, while the upper limit thereof is 13.00% from the viewpoint of stably forming a single phase structure of martensite.

W is an element which significantly enhances the creep strength by taking advantage of solid solution strengthening and, in particular, markedly enhances the long-term creep strength at a high temperature of 500° C. or above. When W is added in an amount exceeding 5.00%, it is precipitated in a large amount as a Laves phase type intermetallic compound around the grain boundaries, resulting in remarkably lowered toughness of the base material and creep strength. For this reason, the upper limit of the W content is 5.00%. On the other hand, when the W content is less than 0.10%, the solid solution strengthening effect is unsatisfactory, so that the lower limit of the W content is 0.10%.

Co is an element which is effective for lowering the Cr equivalent without significantly affecting mechanical properties of the material, such as strength toughness, and thermodynamic properties, such as transformation point. When Co is added in an amount of less than 0.05%, it is ineffective as the austenite stabilizer. On the other hand, the addition of Co in an amount exceeding 6.00% causes the precipitation of a large amount of an intermetallic compound composed mainly of Co (which is different from the intermetallic compound substantially having a composition of $Cr_{40}Mo_{20}Co_{20}W_{10}C_2$—Fe in structure and properties), resulting in lowered creep rupture strength of the base material. For this reason, the Co content is limited to 0.05 to 6.00%.

Mo too is an element which enhances the high temperature strength by taking advantage of solid solution strengthening. When the Mo content is less than 0.01%, the contemplated effect is unsatisfactory. On the other hand, when it exceeds 3.00%, a large amount of $Mo_2C$ type carbide or an $Fe_2Mo$ type intermetallic compound is precipitated. In this case, when Mo is added together with W, the toughness of the base material is, in some cases, remarkably deteriorated. For this reason, the upper limit of the Mo content is 3.00%.

V is an element which, when precipitated as a precipitate and also when dissolved in a solid solution form in the matrix as with W, remarkably enhances the high temperature creep rupture strength of the steel. In the present invention, when the V content is less than 0.002%, the precipitation strengthening by taking advantage of V precipitate is unsatisfactory. On the other hand, when it exceeds 0.800%, a cluster of V-base carbide or carbonitride is created, leading to lowered toughness. For the above reason, the amount of V added is limited 0.002 to 0.800.

Nb is precipitated as an MX type carbide or a carbonitride to enhance the high temperature strength and, at the same time, contributes to solid solution strengthening. The addition of Nb in an amount of less than 0.002% offers no contemplated effect, while when Nb is added in an amount exceeding 0.500%, it is coarsely precipitated resulting in deteriorated toughness. For the above reason, the Nb content is limited to 0.002 to 0.500%.

N is dissolved in a solid solution form in the matrix or precipitated as a nitride or a carbonitride, that is, precipitated mainly as VN, NbN, or carbonitride thereof to contribute to not only solid solution strengthening but also to precipitation strengthening. When the N content is less than 0.002%, the contribution to the strengthening can hardly be obtained. On the other hand, the upper limit of the N content is 0.200% from the viewpoint of the upper limit of the amount of N which can be added in relation with the amount of Cr added up to 13%.

The addition of at least one of Ca, Ba, Mg, Y, Ce, and La in respective amounts limited to Ca: 0.0005 to 0.0050%, Ba: 0.0003 to 0.0020%, Mg: 0.0005 to 0.0050%, La: 0.001 to 0.020%, Ce: 0.001 to 0.020%, and Y: 0.001 to 0.020% is one of the basic techniques constituting the present invention and can prevent, by about 90%, the precipitation of the intermetallic compound substantially having a composition of $Cr_{40}Mo_{20}Co_{20}W_{10}C_2$—Fe in a film form at grain boundaries. Ca, Ba, and Mg are hardly dissolved in a solid solution form in the steel and are present as inclusions in the form of a sulfide mainly around grain boundaries and in the form of an oxide independently of whether they are present at grain boundaries or within grains. Each of them is an element which can strongly inhibit the formation of an intermetallic compound of $Cr_{40}Mo_{20}Co_{20}W_{10}C_2$—Fe and is temporarily decomposed from a sulfide or an oxide to break the lattice structure of the intermetallic compound, resulting in the formation of a different spherical intermetallic compound or redissolution of the intermetallic compound in a solid solution form in the steel.

La, Ce, and Y inhibit the formation of the intermetallic compound through the same mechanism as in the case of Ca, Ba, and Mg independently of whether they are present as a sulfide or as an oxide or dissolved in a solid solution form in the matrix. In this case, Y, Ce, and La in solid solution have a higher capability of inhibiting the formation of the intermetallic compound than Y, Ce, and La as a precipitate. In any case, the highest effect can be attained when the composition falls within the above range. When the content thereof is below the above range, the contemplated effect is unsatisfactory. On the other hand, when it is above the above range, Ca, Ba, and Mg deteriorate the hot workability, while Y, Ce, and La form a large number of coarse oxides, resulting in lowered toughness. For the above reason, the composition range is limited as described above.

Ti and Zr capture C, as a very small amount of element constituting the intermetallic compound, by taking advantage of a strong capability of forming carbide and, consequently, spheroidize the intermetallic compound. This technique also is the basis of the present invention. For each of these elements, when the content is less than 0.002%, the effect is unsatisfactory, while when it exceeds 0.500%, coarse carbide, carbonitride or nitride is precipitated resulting in lowered toughness. For this reason, the content of these element is limited to 0.002 to 0.500%.

The formation of the intermetallic compound $Cr_{40}Mo_{20}Co_{20}W_{10}C_2$—Fe cannot be completely prevented without applying a combination of the addition of one or both of Ti and Zr with the addition of at least one member selected from Ca, Ba, Mg, Ce, Y, and La. If this combination is not applied, it is impossible to ensure the contemplated mechanical properties. The addition of this combination is a feature which is essential and most important to the present invention. The effect attained by the addition of the above combination has been confirmed based on the following experiment.

Steels containing constituents falling within the scope of the composition of the steel of the present invention, except for Ti, Zr, Ca, Ba, Mg, La, Ce, and Y, were prepared by a melt process in VIM (vacuum induction melting furnace) or EF (electric furnace). AOD (argon-oxygen blowing decarburization refining furnace), VOD (vacuum-oxygen blowing decarburization refining furnace) and LF (ladle refining furnace) were optionally selected and used, and the molten steel was cast in a continuous casting equipment or a conventional ingot casting equipment. In the case of the continuous casting, the steel was cast into a slab having a maximum sectional size of 210×1600 mm, or a billet having a smaller sectional area than the slab. On the other hand, in the case of casting using the conventional ingot casting equipment, the steel was cast into an ingot which was then forged or hot-rolled to prepare ingot test pieces having sizes which do not hinder subsequent investigations (various sizes ranging from 10 kg to 20 tons).

The slabs, billets, and ingot test pieces were subjected to solution treatment (normalizing treatment) at 1100° C. for one hr, air cooled to quench the test pieces, thereby forming a martensitic structure, and reheated to 780° C., a temperature below the approximate A1 transformation point of the steel of the present invention, tempered for one hr, and then air cooled.

In the case of the hot-rolled material as shown in FIG. 1, a test piece (2) for the evaluation of creep rupture strength was extracted, from the test pieces after the heat treatment, in a direction parallel to the rolling direction (3) of the steel plate (1), while in the case of the forged ingot test piece, a test piece for the evaluation of creep rupture strength was extracted, from the test pieces after the heat treatment, in the longitudinal direction of the test piece. In order to investigate the behavior of precipitation of an intermetallic compound in the material under test, a block test piece was taken off from a creep ruptured test piece, the substrate was electrolyzed using an organic acid, and the resultant precipitate was collected by suction filtration and then extracted. The extraction residue was quantitatively determined by atomic-absorption spectroscopy or gas chromatography using a calibration curve, or alternatively qualitatively determined by X-ray diffractometry to confirm the presence of precipitates. If necessary, a thin film sample or a replica sample was prepared, and the structural analysis of the precipitate was carried out to observe the form of the precipitate.

For the evaluation of the creep rupture strength, the $10^5$-hour linear-extrapolated rupture strength was estimated by linear extrapolation based on data obtained by the measurement of creep rupture strength at 650° C. over a period of $10^4$ hr. In this case, a $10^5$-hour linear-extrapolated rupture strength of 100 MPa was set as a reference value on the assumption that the boiler is operated under conditions of 650° C. and 350 bar and by taking into consideration stress applied under such conditions to components of steam piping, heat exchangers and the like. Specifically, when the $10^5$-hour linear-extrapolated rupture strength at 650° C. exceeds 100 MPa, the evaluation was such that the intermetallic compound was hardly precipitated and the creep rupture strength contemplated in the present invention could be attained.

Figure 2:
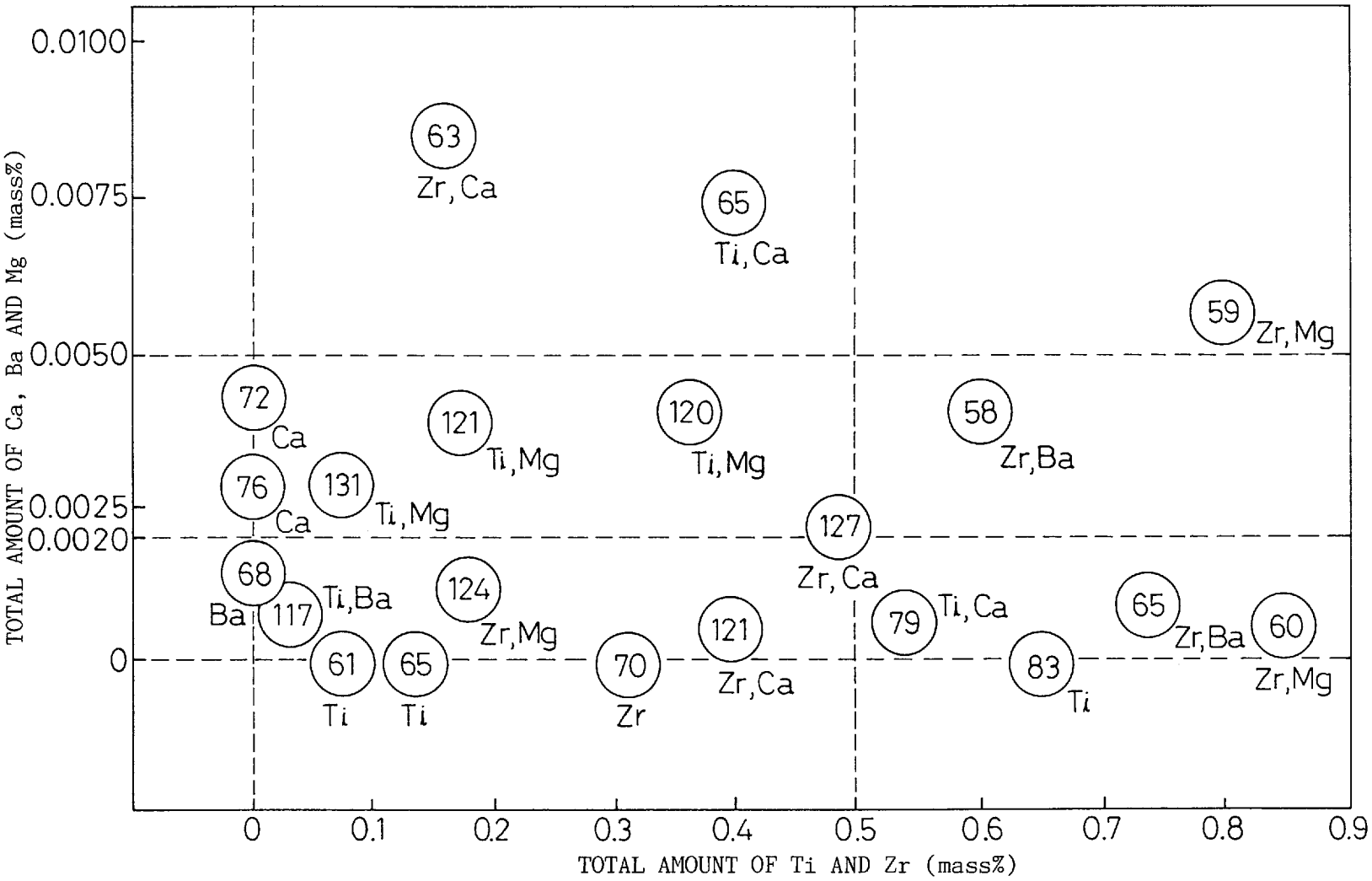
FIG. 2 is a graph showing the effect attained by the addition of Ti and Zr in combination with Ca, Ba, and Mg.

FIG. 2 is a diagram prepared by plotting $10^5$-hour linear-extrapolated rupture strength at 650° C. (unit of numerals: MPa) against the concentration of additive element in the case of the addition of one of Ti and Zr and the addition of one of Ca, Mg, and Ba. The numeral within the plotted circle represents the creep rupture strength (MPa). The symbol of element described below or on the side of the circle represents the selected additive element species.

As is apparent from FIG. 2, when one of Ti and Zr is added alone, or when one of Ca, Ba, and Mg is added alone, the $10^5$-hour linear-extrapolated rupture strength at 650° C. is not more than 100 MPa independently of the amount of the additive element added. This suggests that the addition of Ti and Zr alone or the addition of Ca, Mg, and Ba alone cannot inhibit the precipitation of the intermetallic compound resulting in lowered creep rupture strength. On the other hand, when one of Ti and Zr and one of Ca, Mg, and Ba are added in combination in respective amounts specified in the claims of the present application, that is, Ti and Zr: 0.002 to 0.500%, Ca and Mg: 0.0005 to 0.0050%, and Ba: 0.0003 to 0.0020%, the creep rupture strength exceeds 100 MPa. The analysis using an electron microscope and the quantitative or qualitative analysis of the electrolytic extraction residue have revealed that, for test pieces having a creep rupture strength of not less than 100 MPa, an intermetallic compound (estimated to be a subspecies of ASTM card No. 23-196) substantially having a composition of $Cr_{40}Mo_{20}Co_{20}W_{10}C_2$—Fe is not precipitated. On the other hand, when Ti, Zr, Ca, Mg, and Ba have been added in an amount outside the scope of the composition of the present invention, the presence of an intermetallic compound substantially having a composition of $Cr_{40}Mo_{20}Co_{20}W_{10}C_2$—Fe could be detected.

Figure 3:
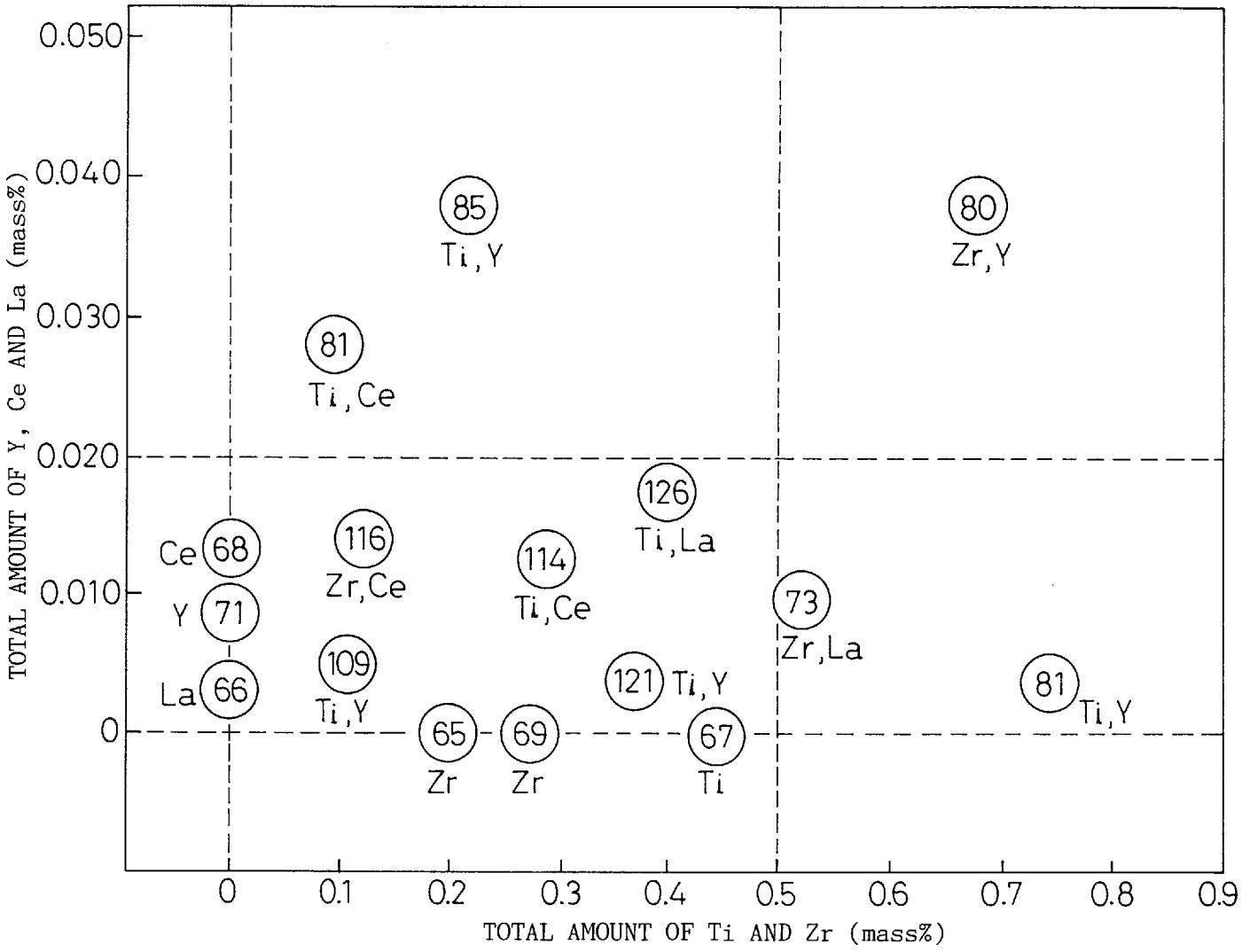
FIG. 3 is a graph showing the effect attained by the addition of Ti and Zr in combination with La, Ce, and Y.

FIG. 3 shows the results of an experiment conducted in the same manner as described above, except that a group of elements Ca, Mg, and Ba shown in FIG. 2 have been replaced with Y, Ce, and La. The behavior of Y, Ce, and La was quite the same as that of Ca, Mg, and Ba. Specifically, in the case of Y, Ce and La: 0.001 to 0.020% and Ti and Zr: 0.002 to 0.500%, the $10^5$-hour linear-extrapolated rupture strength at 650° C. was not less than 100 MPa, and no intermetallic compound substantially having a composition of $Cr_{40}Mo_{20}Co_{20}W_{10}C_2$—Fe was detected. On the other hand, when Ti, Zr, Ca, Mg, and Ba have been added in an amount outside the scope of the composition of the present invention, the presence of an intermetallic compound substantially having a composition of $Cr_{40}Mo_{20}Co_{20}W_{10}C_2$—Fe could be detected. Further, in this case, the creep rupture strength was always less than 100 MPa.

Further, in the case of the addition of Ti and Zr in combination and in the case of the addition of at least two members selected from Ca, Mg, Ba, Y, La, and Ce, when the amounts of the elements added fall within the scope of the composition of the present invention and when the amount of even one of the elements added is outside the scope of the composition of the present invention, the results were quite the same as those described above. Some of the results are summarized in Table 1.

Thus, it has been found that it is necessary to add one or both of Ti and Zr in combination with at least one member selected from Ca, Mg, Ba, Y, Ce, and La and these elements should be added in respective amounts specified in the claims of the present application.

The method of melting the steel of the present invention is not particularly limited, and the process used may be determined by taking into consideration the chemical composition of the steel and the cost. For example, a converter, an induction heating furnace, an arc melting furnace, and an electric furnace may be used. In the step of smelting, however, hoppers for the addition of Ti, Zr, Ca, Mg, Ba, Y, Ce, and La should be provided, and the concentration of oxygen in the molten metal should be regulated on a level low enough to prevent slag-out of these additive elements as oxides. Therefore, the use of an Ar gas blower, LF equipped with an arc heater or a plasma heater, or a vacuum degassing apparatus is advantageous and can enhance the effect of the present invention. Other steps, specifically, all step which are considered necessary or useful for the preparation of steels or steel products according to the present invention, such as rolling, heat treatment, pipe making, welding, cutting, and inspection can be applied and are not detrimental to the effect of the present invention.

In particular, regarding the step of producing steel pipes, methods usable herein include a method wherein, after a round billet or an angular billet is prepared under conditions including the production process according to the present invention, it is hot-extruded or subjected to various types of seamless rolling to prepare seamless pipes and tubes, a method wherein a sheet is hot-rolled, cold-rolled, and subjected to electric resistance welding to prepare an electric resistance welded pipe, and a method wherein TIG welding, MIG welding, SAW welding, LASER welding, and EB welding are used alone or in combination to prepare a welded pipe. Further, after each of the above methods, hot or warm SR (stretch reducing) or non-proportional rolling and, in addition, various straightening steps may be added and practiced, enabling the range of dimension applicable to the steel of the present invention to be increased.

Further, the steel of the present invention can also be provided in the form of a plate or a sheet, and the plate or sheet after necessary heat treatment may be used in various forms of heat resistant materials without detriment to the effect of the present invention.

In addition, it is also possible to apply powder metallurgy, such as HIP (hot isostatic pressing sintering equipment), CIP (cold isostatic pressing molding equipment), and sintering, and the resultant molding is subjected to necessary heat treatment to prepare products of various forms.

The above steel pipes, plates or sheets and other heat resistant members having various forms may be subjected to various types of heat treatment, according to the purpose and application, which are important for satisfactorily attaining the effect of the present invention.

In many cases, normalizing (solution treatment) and tempering are carried out to provide products. In addition, re-tempering and normalizing may be usefully conducted alone or in combination. However, after the solution treatment, the stopping of cooling and holding are indispensable.

In the case of a relatively high nitrogen content or carbon content and the incorporation of austenite stabilizers, such as Co and Ni, in a large amount, when the Cr equivalent is low, the steel may be cooled to 0° C. or below, that is, subjected to subzero treatment, in order to avoid the retained austenitic phase. This treatment is effective in satisfactorily developing the mechanical properties of the steel of the present invention.

Each of the above steps may be repeated in a plurality of times necessary for satisfactorily developing the properties of the material. This is not detrimental to the effect of the present invention.

The above steps may be properly selected and applied to the process for producing a steel according to the present invention.

EXAMPLE

Steels, of the present invention, listed in Table 1 were prepared in an amount of 300 tons, 120 tons, 60 tons, 1 ton, 300 kg, 100 kg, and 50 kg by a melt process using conventional blast furnace iron-converter blowing, VIM, EF, or vacuum melting system on a laboratory scale, refined in an LF system, which has arc reheating equipment and into which Ar is blown, or a small-scale reproduction test system having an equivalent capability, and continuously cast into a slab of 1200 mm×210 mm or a billet of 560×210 mm or alternatively subjected to conventional ingot casting to prepare 50 kg to 50 tons of a steel ingot. The slab, billet, and steel ingot were hot-rolled or hot-forged into a plate having a thickness of 50 mm and a sheet having a thickness of 12 mm or alternatively worked into a round billet which was then hot-extruded into a tube having an outer diameter of 74 mm and a wall thickness of 10 mm or subjected to seamless rolling to prepare a pipe having an outer diameter of 380 mm and a wall thickness of 50 mm. The sheet was formed and subjected to electric resistance welding to prepare an electric resistance welded pipe having an outer diameter of 280 mm and a wall thickness of 12 mm.

All the plates and pipes were subjected to solution treatment under conditions of a maximum heating temperature of 950° to 1350° C. and a holding time of one hr, air cooled, and then tempered at 750° to 800° C. for one hr.

The creep property was measured as shown in FIG. 1. Specifically, a creep test piece (2) having a diameter of 6 mm was taken off, the creep rupture strength was measured at 650° C. over a period of $10^4$ hr, and the data thus obtained were linearly extrapolated to determine the $10^5$-hr linear-extrapolated rupture strength.

Figure 4:
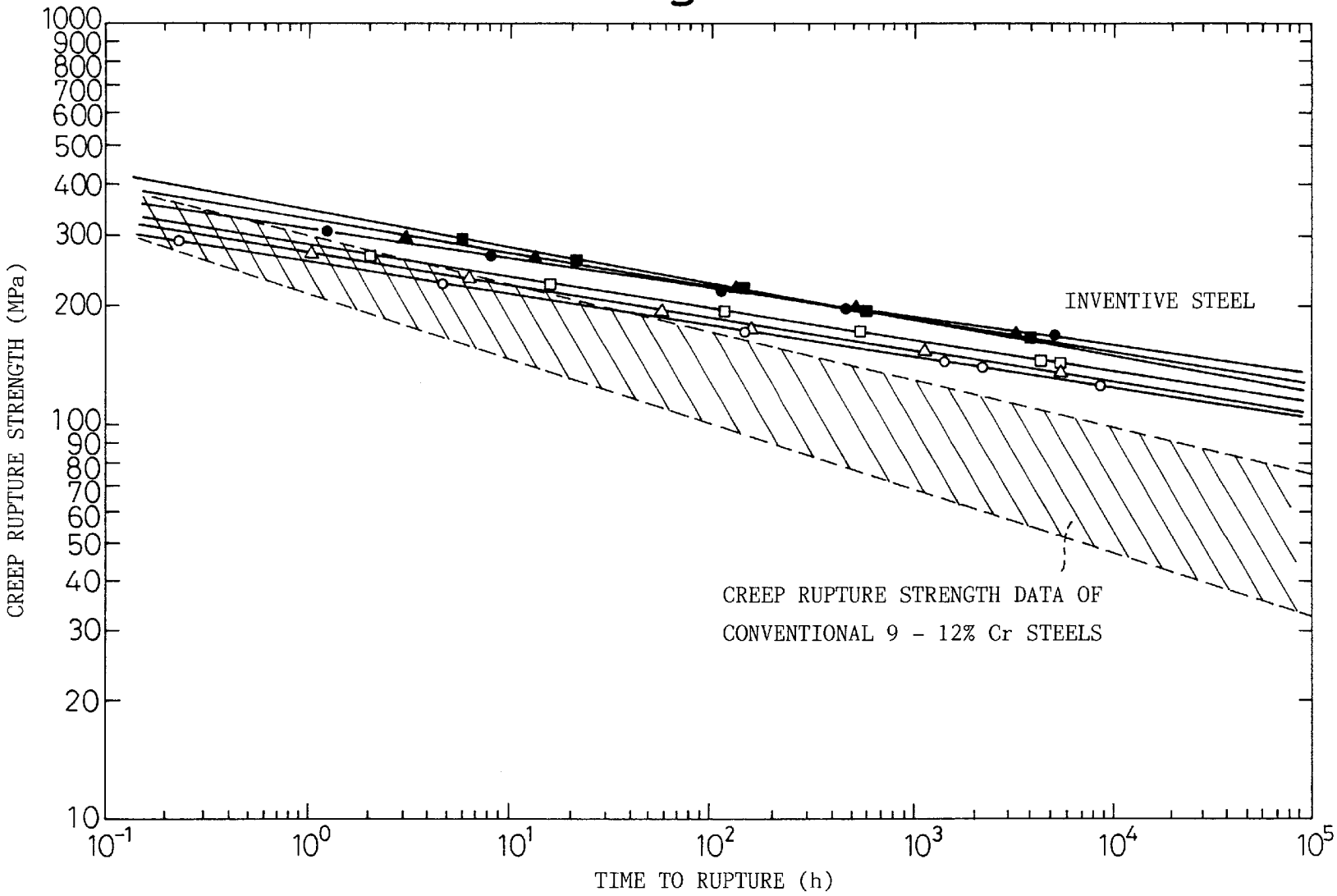
FIG. 4 is a graph showing an example of the results of evaluation of the creep rupture strength and the $10^5$-hr linear-extrapolated rupture strength at 650° C. in comparison with data band on the creep rupture strength of the conventional 9–12% Cr steel.

The results of measurement of the creep rupture strength over a period of $10^4$ hr of the parent metal, together with an extrapolated line for the $10^5$-hr rupture strength, are shown in FIG. 4. As can be seen from FIG. 4, the high temperature rupture strength of the steels of the present invention is higher than that of the conventional 9–12% Cr steel.

Figure 5:
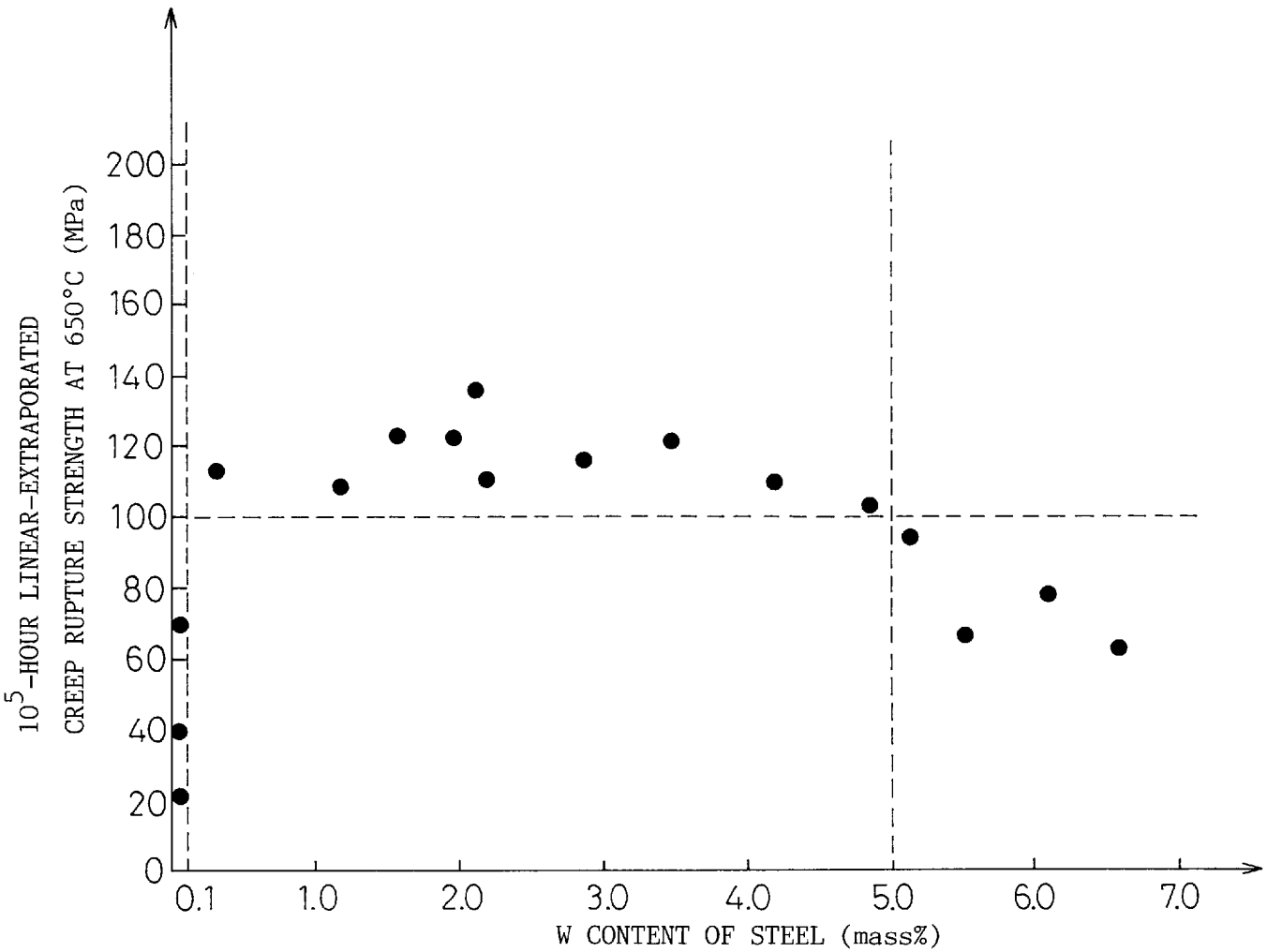
FIG. 5 is a graph showing the relationship between the W content of the steel and the creep rupture strength.

FIG. 5 is a diagram showing the W content and the $10^5$-hour linear-extrapolated rupture strength at 650° C. As is apparent from the drawing, when the W content is in the range of from 0.10 to 5.00%, the creep rupture strength exceeds 100 MPa.

Figure 6:
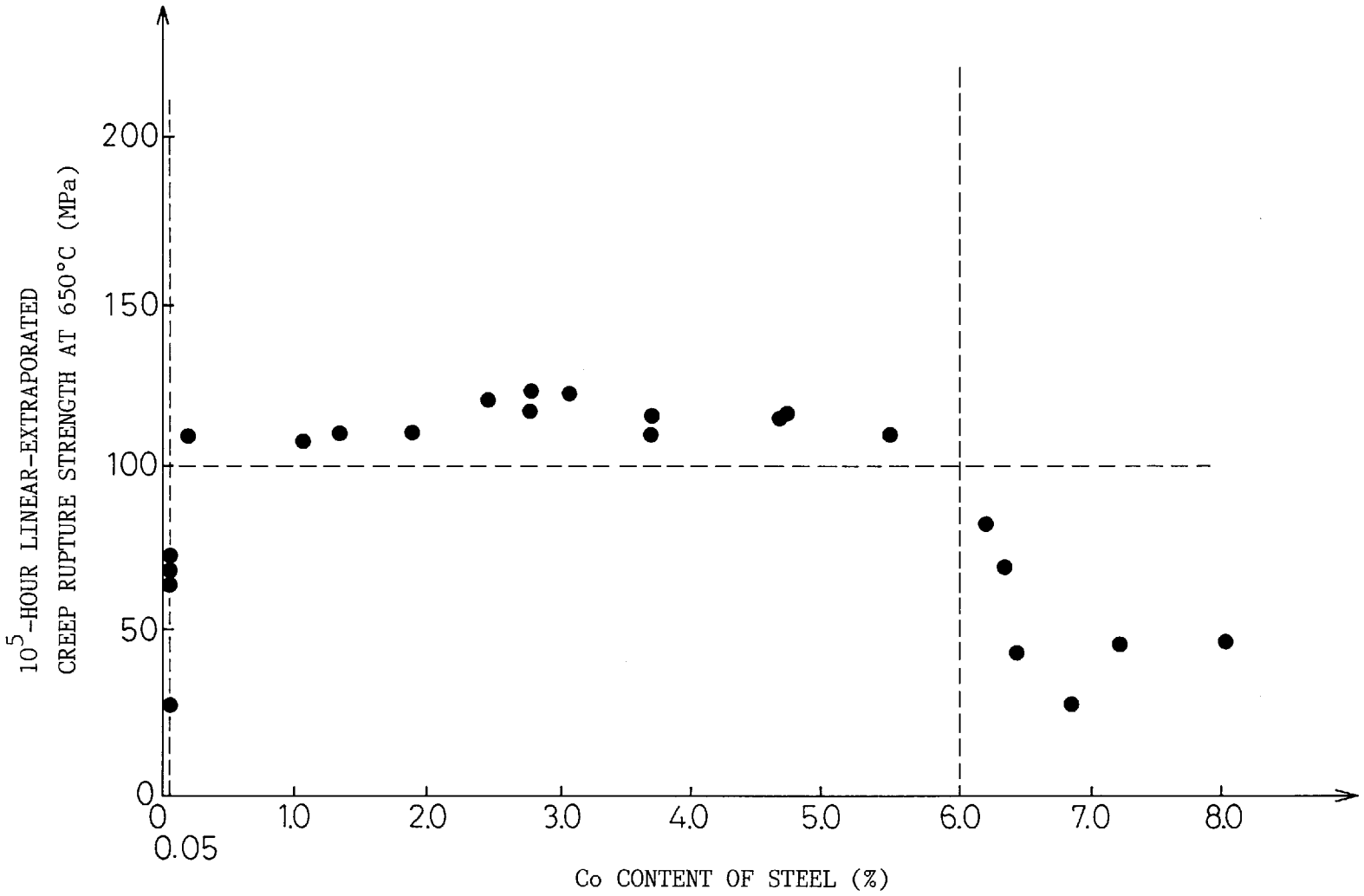
FIG. 6 is a graph showing the relationship between the Co content of the steel and the creep rupture strength.

FIG. 6 is a diagram showing the relationship between the Co content and the $10^5$-hr linear-extrapolated rupture strength at 650° C. As can be seen from the drawing, when the Co content is not less than 0.05%, the creep rupture strength is not less than 100 MPa, whereas when Co is added in an amount exceeding 6.0%, an intermetallic compound composed mainly of Co is precipitated resulting in deteriorated creep rupture strength.

For comparison, steels, of which the chemical composition are outside the scope of the present invention, were evaluated in the same manner as described above. The chemical composition and, among the evaluation results, CRS ($10^5$-hr linear-extrapolated rupture strength at 650° C. estimated by linear extrapolation of the measurements of creep rupture strength at 650° C. over a period of $10^4$ hr) and analytical results for an intermetallic compound are summarized in Table 2.

In Table 2, among the comparative steels, steels No. 98 and 99 are steel examples, containing neither Ti nor Zr, which caused the precipitation of an intermetallic compound, in a film form, substantially having a composition of $Cr_{40}Mo_{20}Co_{20}W_{10}C_2$—Fe in grain boundaries during the creep test at 650° C., resulting in lowered $10^5$-hour liner-extrapolated rupture strength at 650° C. Steel No. 100 is a steel example, containing more than 0.5% of Ti, which has caused the formation of a large amount of a coarse carbonitride, resulting in a very low toughness at 0° C. of 2 J as measured immediately after heat treatment and, at the same time, lowered creep rupture strength. Steel No. 101 is a steel example, containing more than 0.5% of Zr, which has caused the formation of a coarse carbonitride, resulting in a very low toughness at 0° C. of 1 J as measured immediately after heat treatment and, at the same time, lowered creep rupture strength. Steel No. 102 is a steel example, containing Ti and Zr both in an amount exceeding 0.5%, which has caused the formation of a large amount of a coarse carbonitride, resulting in a very low toughness at 0° C. of 0.5 J as measured immediately after heat treatment and, at the same time, lowered creep rupture strength. Steel Nos. 103 and 104 are steel examples, containing Ti and Zr but not containing at least one member selected from Ca, Ba, Mg, La, Ce, and Y, which caused the precipitation of an intermetallic compound, in a film form, substantially having a composition of $Cr_{40}Mo_{20}Co_{20}W_{10}C_2$—Fe in grain boundaries during the creep test at 650° C., resulting in lowered $10^5$-hr liner-extrapolated rupture strength at 650° C.

Steel No. 105 is a steel example containing more than 0.005% of Ca, steel No. 106 is a steel example containing more than 0.005% of Mg, steel No. 107 is a steel example containing more than 0.02% of Y, and steel No. 108 is a steel example containing more than 0.02% of Ce. For the steel examples respectively containing Ca and Mg, the hot workability has been deteriorated and the steel ingot was broken during hot rolling, making it impossible to produce the contemplated product. For the steel examples respectively containing Y and Ce, a large number of coarse oxides were produced in a large amount resulting in very lowered touhnesses of 0.8 J and 0.5 J at 0° C. immediately after heat treatment. Further, in this case, since substantially the whole quantity of Y or Ce was present as an oxide in the steel, the effect of inhibiting the formation of an intermetallic compound could not be developed, resulting in lowered creep rupture strength. Steel No. 109 is a steel example, not containing W, which had low creep rupture strength. Steel example 110 is a steel example, containing an excessive amount of W, which has caused the precipitation of a large amount of $Fe_2W$ type Laves phase, resulting in lowered creep rupture strength. Steel No. 111 is a steel example, unsatisfactory in Co content, which has caused a large amount of retained delta ferrite resulting in lowered creep strength. Steel No. 112 is a steel example, having an excessive Co content, which has caused the precipitation of an intermetallic compound composed mainly of Co ($Fe_2Co$), resulting in lowered creep rupture strength.

TABLE 1

| Inventive Steels | | | | | | | | | | | | | |
|---|---|---|---|---|---|---|---|---|---|---|---|---|---|
| No. | C | Si | Mn | P | S | Cr | Mo | W | Co | Nb | V | N | O |
| 1 | 0.262 | 0.789 | 1.071 | 0.0243 | 0.0009 | 11.115 | 0.246 | 3.490 | 1.759 | 0.070 | 0.600 | 0.0467 | 0.0075 |
| 2 | 0.107 | 0.132 | 0.262 | 0.0021 | 0.0023 | 10.397 | 0.225 | 4.399 | 4.264 | 0.005 | 0.399 | 0.1721 | 0.0145 |
| 3 | 0.266 | 0.613 | 1.016 | 0.0261 | 0.0014 | 9.842 | 0.223 | 3.511 | 5.813 | 0.269 | 0.521 | 0.1652 | 0.0168 |
| 4 | 0.208 | 0.626 | 0.299 | 0.0077 | 0.0083 | 8.667 | 0.107 | 2.201 | 1.456 | 0.205 | 0.340 | 0.1186 | 0.0008 |
| 5 | 0.078 | 0.207 | 1.202 | 0.0145 | 0.0071 | 10.110 | 0.076 | 1.923 | 4.499 | 0.442 | 0.760 | 0.1522 | 0.0152 |
| 6 | 0.050 | 0.016 | 0.218 | 0.0030 | 0.0091 | 11.966 | 0.243 | 3.500 | 5.545 | 0.327 | 0.599 | 0.1553 | 0.0001 |
| 7 | 0.244 | 0.324 | 1.230 | 0.0266 | 0.0060 | 12.213 | 0.176 | 3.740 | 2.007 | 0.161 | 0.578 | 0.1121 | 0.0172 |
| 8 | 0.080 | 0.524 | 0.921 | 0.0144 | 0.0053 | 9.906 | 0.095 | 0.598 | 1.364 | 0.322 | 0.751 | 0.0529 | 0.0065 |
| 9 | 0.260 | 0.216 | 0.878 | 0.0030 | 0.0085 | 12.995 | 0.064 | 2.204 | 0.875 | 0.060 | 0.443 | 0.0082 | 0.0105 |
| 10 | 0.277 | 0.117 | 0.795 | 0.0150 | 0.0033 | 10.285 | 0.260 | 4.848 | 3.938 | 0.125 | 0.429 | 0.1513 | 0.0119 |
| 11 | 0.117 | 0.399 | 1.073 | 0.0066 | 0.0021 | 10.366 | 0.191 | 0.268 | 5.019 | 0.465 | 0.790 | 0.0890 | 0.0097 |
| 12 | 0.201 | 0.289 | 1.190 | 0.0234 | 0.0064 | 12.409 | 0.125 | 2.010 | 2.426 | 0.147 | 0.207 | 0.1641 | 0.0166 |
| 13 | 0.022 | 0.504 | 1.493 | 0.0010 | 0.0077 | 9.843 | 0.050 | 2.669 | 0.750 | 0.324 | 0.785 | 0.0280 | 0.0050 |
| 14 | 0.093 | 0.335 | 0.855 | 0.0037 | 0.0004 | 9.097 | 0.253 | 1.420 | 0.614 | 0.050 | 0.207 | 0.1542 | 0.0004 |
| 15 | 0.038 | 0.581 | 1.012 | 0.0279 | 0.0028 | 12.140 | 0.084 | 3.763 | 0.108 | 0.133 | 0.194 | 0.0410 | 0.0180 |
| 16 | 0.262 | 0.145 | 0.313 | 0.0275 | 0.0004 | 12.600 | 0.034 | 0.827 | 4.837 | 0.411 | 0.041 | 0.0835 | 0.0183 |
| 17 | 0.077 | 0.605 | 1.478 | 0.0118 | 0.0034 | 8.374 | 0.225 | 1.908 | 5.295 | 0.048 | 0.563 | 0.0634 | 0.0080 |
| 18 | 0.149 | 0.520 | 1.261 | 0.0086 | 0.0030 | 8.364 | 0.227 | 2.248 | 1.270 | 0.033 | 0.784 | 0.1757 | 0.0126 |
| 19 | 0.292 | 0.466 | 1.144 | 0.0082 | 0.0033 | 9.464 | 0.241 | 3.810 | 2.171 | 0.021 | 0.412 | 0.1523 | 0.0003 |
| 20 | 0.154 | 0.483 | 0.814 | 0.0106 | 0.0031 | 9.131 | 0.251 | 3.392 | 0.790 | 0.198 | 0.413 | 0.0709 | 0.0116 |
| 21 | 0.261 | 0.127 | 0.928 | 0.0244 | 0.0025 | 12.368 | 0.099 | 4.127 | 2.037 | 0.199 | 0.162 | 0.1178 | 0.0004 |
| 22 | 0.221 | 0.142 | 0.762 | 0.0251 | 0.0039 | 12.074 | 0.162 | 3.237 | 5.945 | 0.053 | 0.169 | 0.0504 | 0.0169 |
| 23 | 0.189 | 0.782 | 1.320 | 0.0075 | 0.0014 | 10.723 | 0.153 | 0.251 | 1.341 | 0.066 | 0.684 | 0.1017 | 0.0040 |
| 24 | 0.288 | 0.018 | 1.025 | 0.0011 | 0.0099 | 12.333 | 0.183 | 3.496 | 1.567 | 0.476 | 0.031 | 0.0681 | 0.0050 |
| 25 | 0.068 | 0.238 | 1.479 | 0.0117 | 0.0000 | 11.548 | 0.239 | 4.567 | 0.847 | 0.453 | 0.058 | 0.1713 | 0.0177 |
| 26 | 0.185 | 0.449 | 1.322 | 0.0190 | 0.0043 | 9.240 | 0.174 | 1.550 | 4.862 | 0.464 | 0.743 | 0.1094 | 0.0190 |
| 27 | 0.256 | 0.761 | 0.813 | 0.0129 | 0.0061 | 10.798 | 0.184 | 4.066 | 0.266 | 0.447 | 0.608 | 0.1561 | 0.0172 |
| 28 | 0.108 | 0.176 | 0.588 | 0.0091 | 0.0026 | 10.572 | 0.231 | 0.164 | 3.682 | 0.113 | 0.681 | 0.1642 | 0.0156 |
| 29 | 0.170 | 0.412 | 0.488 | 0.0255 | 0.0069 | 8.932 | 0.276 | 3.063 | 0.707 | 0.220 | 0.583 | 0.0547 | 0.0095 |
| 30 | 0.067 | 0.256 | 0.522 | 0.0056 | 0.0051 | 12.068 | 0.265 | 3.530 | 2.883 | 0.304 | 0.553 | 0.1086 | 0.0031 |
| 31 | 0.060 | 0.644 | 0.777 | 0.0167 | 0.0012 | 11.183 | 0.040 | 0.350 | 3.138 | 0.034 | 0.607 | 0.0393 | 0.0092 |
| 32 | 0.285 | 0.637 | 0.660 | 0.0258 | 0.0062 | 8.102 | 0.163 | 3.447 | 0.700 | 0.253 | 0.519 | 0.0799 | 0.0135 |
| 33 | 0.011 | 0.776 | 0.465 | 0.0022 | 0.0084 | 11.197 | 0.162 | 2.179 | 0.978 | 0.217 | 0.685 | 0.1839 | 0.0001 |
| 34 | 0.053 | 0.406 | 1.005 | 0.0162 | 0.0025 | 11.535 | 0.241 | 1.920 | 1.463 | 0.077 | 0.658 | 0.1830 | 0.0009 |
| 35 | 0.261 | 0.447 | 1.347 | 0.0200 | 0.0008 | 8.851 | 0.255 | 4.402 | 2.492 | 0.424 | 0.600 | 0.0701 | 0.0127 |
| 36 | 0.216 | 0.377 | 0.346 | 0.0283 | 0.0008 | 10.300 | 0.262 | 4.549 | 0.097 | 0.215 | 0.208 | 0.0839 | 0.0128 |
| 37 | 0.281 | 0.095 | 0.414 | 0.0101 | 0.0050 | 8.853 | 0.155 | 1.481 | 5.739 | 0.300 | 0.741 | 0.0609 | 0.0142 |
| 38 | 0.249 | 0.546 | 0.943 | 0.0204 | 0.0089 | 11.860 | 0.191 | 2.210 | 5.319 | 0.193 | 0.022 | 0.1226 | 0.0129 |
| 39 | 0.206 | 0.482 | 1.150 | 0.0193 | 0.0092 | 8.810 | 0.294 | 0.139 | 5.346 | 0.146 | 0.705 | 0.0733 | 0.0087 |
| 40 | 0.251 | 0.613 | 0.307 | 0.0051 | 0.0099 | 8.365 | 0.168 | 0.583 | 0.093 | 0.063 | 0.700 | 0.0557 | 0.0180 |
| 41 | 0.018 | 0.123 | 1.076 | 0.0262 | 0.0039 | 9.269 | 0.270 | 0.736 | 1.036 | 0.301 | 0.341 | 0.0052 | 0.0029 |
| 42 | 0.073 | 0.514 | 1.338 | 0.0008 | 0.0064 | 11.594 | 0.219 | 2.814 | 3.507 | 0.310 | 0.746 | 0.0510 | 0.0147 |
| 43 | 0.121 | 0.679 | 0.845 | 0.0169 | 0.0004 | 11.494 | 0.026 | 2.088 | 4.862 | 0.046 | 0.666 | 0.0808 | 0.0181 |
| 44 | 0.128 | 0.684 | 1.426 | 0.0204 | 0.0040 | 11.864 | 0.236 | 3.715 | 1.830 | 0.220 | 0.364 | 0.1961 | 0.0195 |
| 45 | 0.167 | 0.422 | 0.500 | 0.0181 | 0.0071 | 11.859 | 0.049 | 1.549 | 5.350 | 0.349 | 0.503 | 0.1491 | 0.0048 |
| 46 | 0.097 | 0.630 | 1.298 | 0.0233 | 0.0008 | 10.326 | 0.252 | 1.559 | 1.067 | 0.485 | 0.333 | 0.0869 | 0.0027 |
| 47 | 0.204 | 0.652 | 0.914 | 0.0053 | 0.0051 | 12.434 | 0.051 | 3.227 | 1.564 | 0.192 | 0.744 | 0.0653 | 0.0098 |
| 48 | 0.275 | 0.251 | 1.011 | 0.0159 | 0.0077 | 8.723 | 0.173 | 4.947 | 2.900 | 0.082 | 0.192 | 0.0022 | 0.0162 |
| 49 | 0.024 | 0.326 | 0.876 | 0.0052 | 0.0001 | 10.965 | 0.111 | 3.064 | 3.536 | 0.201 | 0.041 | 0.0855 | 0.0060 |
| 50 | 0.293 | 0.153 | 0.842 | 0.0059 | 0.0052 | 11.238 | 0.220 | 4.236 | 0.343 | 0.171 | 0.536 | 0.1884 | 0.0003 |
| 51 | 0.029 | 0.318 | 1.158 | 0.0114 | 0.0086 | 12.867 | 0.242 | 3.372 | 1.138 | 0.107 | 0.706 | 0.1203 | 0.0004 |
| 52 | 0.211 | 0.032 | 1.079 | 0.0145 | 0.0013 | 8.515 | 0.226 | 1.150 | 2.982 | 0.200 | 0.456 | 0.0970 | 0.0086 |
| 53 | 0.266 | 0.428 | 1.098 | 0.0188 | 0.0023 | 8.233 | 0.082 | 3.303 | 4.364 | 0.282 | 0.724 | 0.0288 | 0.0055 |
| 54 | 0.249 | 0.441 | 1.224 | 0.0029 | 0.0071 | 10.977 | 0.124 | 2.355 | 5.168 | 0.179 | 0.329 | 0.0404 | 0.0116 |
| 55 | 0.283 | 0.252 | 0.587 | 0.0171 | 0.0079 | 11.211 | 0.251 | 0.447 | 0.611 | 0.325 | 0.399 | 0.0850 | 0.0042 |
| 56 | 0.283 | 0.644 | 0.656 | 0.0195 | 0.0034 | 11.173 | 0.108 | 4.137 | 0.312 | 0.266 | 0.315 | 0.0646 | 0.0114 |
| 57 | 0.023 | 0.120 | 0.557 | 0.0106 | 0.0067 | 12.543 | 0.052 | 4.221 | 5.146 | 0.220 | 0.177 | 0.0479 | 0.0179 |
| 58 | 0.086 | 0.625 | 0.886 | 0.0029 | 0.0053 | 9.602 | 0.131 | 1.183 | 3.545 | 0.412 | 0.554 | 0.0819 | 0.0126 |
| 59 | 0.234 | 0.389 | 0.594 | 0.0055 | 0.0083 | 11.574 | 0.031 | 4.558 | 5.964 | 0.431 | 0.648 | 0.1818 | 0.0197 |
| 60 | 0.241 | 0.051 | 0.273 | 0.0185 | 0.0087 | 9.477 | 0.206 | 0.762 | 0.815 | 0.218 | 0.129 | 0.1487 | 0.0188 |
| 61 | 0.093 | 0.568 | 0.965 | 0.0041 | 0.0070 | 11.769 | 0.282 | 0.191 | 5.415 | 0.320 | 0.335 | 0.1148 | 0.0114 |
| 62 | 0.265 | 0.635 | 1.075 | 0.0133 | 0.0022 | 9.571 | 0.087 | 3.980 | 4.982 | 0.255 | 0.136 | 0.0710 | 0.0158 |
| 63 | 0.066 | 0.617 | 0.356 | 0.0264 | 0.0020 | 11.725 | 0.212 | 3.773 | 0.758 | 0.267 | 0.188 | 0.1960 | 0.0010 |

TABLE 1-continued

| | | | | | | | | | | | | | |
|---|---|---|---|---|---|---|---|---|---|---|---|---|---|
| Inventive Steels | | | | | | | | | | | | | |
| 64 | 0.152 | 0.643 | 0.351 | 0.0008 | 0.0020 | 9.914 | 0.126 | 0.850 | 3.759 | 0.435 | 0.024 | 0.0641 | 0.0004 |
| 65 | 0.178 | 0.551 | 1.175 | 0.0131 | 0.0030 | 11.935 | 0.078 | 4.351 | 4.845 | 0.031 | 0.418 | 0.1974 | 0.0027 |
| 66 | 0.014 | 0.553 | 0.389 | 0.0122 | 0.0045 | 9.017 | 0.169 | 1.657 | 1.854 | 0.124 | 0.669 | 0.1458 | 0.0103 |
| 67 | 0.160 | 0.681 | 1.007 | 0.0020 | 0.0068 | 9.189 | 0.231 | 2.791 | 1.029 | 0.219 | 0.364 | 0.1167 | 0.0087 |
| 68 | 0.222 | 0.780 | 0.207 | 0.0217 | 0.0085 | 12.797 | 0.132 | 2.320 | 0.623 | 0.112 | 0.418 | 0.1063 | 0.0118 |
| 69 | 0.096 | 0.470 | 1.038 | 0.0080 | 0.0087 | 10.549 | 0.269 | 1.881 | 5.408 | 0.066 | 0.252 | 0.0731 | 0.0162 |
| 70 | 0.250 | 0.490 | 0.729 | 0.0191 | 0.0042 | 10.781 | 0.179 | 3.604 | 5.307 | 0.359 | 0.440 | 0.0840 | 0.0011 |
| 71 | 0.235 | 0.168 | 0.374 | 0.0246 | 0.0051 | 10.399 | 0.014 | 2.126 | 5.989 | 0.052 | 0.059 | 0.0564 | 0.0018 |
| 72 | 0.215 | 0.388 | 0.819 | 0.0283 | 0.0070 | 8.722 | 0.084 | 2.956 | 1.623 | 0.007 | 0.088 | 0.0862 | 0.0082 |
| 73 | 0.217 | 0.782 | 0.816 | 0.0077 | 0.0077 | 12.173 | 0.209 | 4.689 | 3.547 | 0.020 | 0.055 | 0.1714 | 0.0194 |
| 74 | 0.157 | 0.612 | 0.681 | 0.0274 | 0.0042 | 9.960 | 0.230 | 4.577 | 4.260 | 0.221 | 0.689 | 0.0377 | 0.0011 |
| 75 | 0.145 | 0.352 | 0.663 | 0.0116 | 0.0045 | 9.071 | 0.051 | 2.253 | 0.594 | 0.421 | 0.164 | 0.0913 | 0.0126 |
| 76 | 0.136 | 0.569 | 0.532 | 0.0058 | 0.0097 | 9.746 | 0.136 | 3.316 | 4.612 | 0.426 | 0.259 | 0.1840 | 0.0142 |
| 77 | 0.203 | 0.286 | 1.143 | 0.0232 | 0.0061 | 10.521 | 0.256 | 1.022 | 1.267 | 0.361 | 0.561 | 0.0510 | 0.0121 |
| 78 | 0.094 | 0.385 | 0.752 | 0.0050 | 0.0094 | 8.926 | 0.166 | 4.251 | 0.996 | 0.363 | 0.002 | 0.1290 | 0.0102 |
| 79 | 0.151 | 0.371 | 1.147 | 0.0232 | 0.0058 | 11.220 | 0.296 | 0.798 | 0.982 | 0.298 | 0.429 | 0.1158 | 0.0165 |
| 80 | 0.106 | 0.352 | 0.498 | 0.0222 | 0.0006 | 9.884 | 0.280 | 0.407 | 1.110 | 0.384 | 0.318 | 0.1427 | 0.0086 |
| 81 | 0.165 | 0.656 | 1.095 | 0.0064 | 0.0034 | 12.629 | 0.211 | 1.432 | 1.110 | 0.410 | 0.394 | 0.0781 | 0.0115 |
| 82 | 0.132 | 0.214 | 1.026 | 0.0245 | 0.0002 | 10.073 | 0.047 | 1.253 | 4.618 | 0.355 | 0.796 | 0.1040 | 0.0023 |
| 83 | 0.021 | 0.164 | 1.489 | 0.0037 | 0.0055 | 10.500 | 0.144 | 1.058 | 4.348 | 0.167 | 0.464 | 0.0578 | 0.0105 |
| 84 | 0.069 | 0.182 | 0.577 | 0.0263 | 0.0026 | 10.786 | 0.213 | 2.360 | 2.634 | 0.024 | 0.434 | 0.0037 | 0.0070 |
| 85 | 0.258 | 0.130 | 1.330 | 0.0243 | 0.0042 | 11.900 | 0.189 | 1.565 | 4.986 | 0.429 | 0.536 | 0.0402 | 0.0200 |
| 86 | 0.113 | 0.196 | 0.725 | 0.0193 | 0.0043 | 12.768 | 0.039 | 2.351 | 1.996 | 0.350 | 0.223 | 0.0939 | 0.0073 |
| 87 | 0.132 | 0.690 | 1.397 | 0.0278 | 0.0022 | 8.777 | 0.041 | 2.380 | 3.806 | 0.015 | 0.068 | 0.0524 | 0.0001 |
| 88 | 0.028 | 0.631 | 0.544 | 0.0126 | 0.0075 | 9.701 | 0.253 | 2.474 | 0.575 | 0.023 | 0.252 | 0.0911 | 0.0115 |
| 89 | 0.065 | 0.546 | 1.382 | 0.0175 | 0.0079 | 8.068 | 0.045 | 1.956 | 2.650 | 0.171 | 0.419 | 0.1623 | 0.0083 |
| 90 | 0.207 | 0.364 | 0.393 | 0.0257 | 0.0009 | 12.236 | 0.168 | 0.458 | 4.642 | 0.217 | 0.242 | 0.0168 | 0.0181 |
| 91 | 0.014 | 0.018 | 0.804 | 0.0071 | 0.0096 | 8.117 | 0.181 | 2.956 | 4.184 | 0.192 | 0.694 | 0.0291 | 0.0189 |
| 92 | 0.141 | 0.038 | 0.981 | 0.0020 | 0.0068 | 8.098 | 0.297 | 4.117 | 0.489 | 0.320 | 0.587 | 0.1805 | 0.0003 |
| 93 | 0.049 | 0.735 | 1.344 | 0.0083 | 0.0050 | 8.375 | 0.210 | 0.835 | 2.526 | 0.292 | 0.710 | 0.1420 | 0.0112 |
| 94 | 0.190 | 0.685 | 1.219 | 0.0019 | 0.0054 | 9.371 | 0.162 | 3.772 | 3.725 | 0.498 | 0.766 | 0.1552 | 0.0185 |
| 95 | 0.266 | 0.694 | 1.208 | 0.0126 | 0.0012 | 11.607 | 0.174 | 2.689 | 5.947 | 0.428 | 0.429 | 0.1928 | 0.0117 |
| 96 | 0.069 | 0.476 | 1.143 | 0.0168 | 0.0012 | 10.540 | 0.275 | 3.016 | 5.368 | 0.115 | 0.075 | 0.0142 | 0.0158 |
| 97 | 0.162 | 0.073 | 0.263 | 0.0118 | 0.0096 | 10.515 | 0.198 | 4.595 | 4.394 | 0.196 | 0.076 | 0.1853 | 0.0173 |

| No. | Ti | Zr | Ca | Ba | Mg | Y | Ce | La | Ni | Cu | B | CRS | Intermetallic compounds |
|---|---|---|---|---|---|---|---|---|---|---|---|---|---|
| 1 | 0.130 | 0.211 | 0.0034 | 0.0007 | 0.0029 | 0.0142 | 0.0069 | 0.0123 | 1.667 | 1.417 | 0.0017 | 139 | None |
| 2 | | 0.201 | | | | | 0.0059 | | | | | 119 | None |
| 3 | | 0.102 | | | | | 0.0013 | | | | | 128 | None |
| 4 | 0.340 | | | 0.0020 | | | 0.0013 | | 0.717 | | | 109 | None |
| 5 | 0.372 | | 0.0038 | | | | | | | | 0.0046 | 133 | None |
| 6 | 0.369 | | | | | 0.0013 | | | 0.408 | | 0.0007 | 125 | None |
| 7 | 0.026 | | | | 0.0012 | 0.0047 | | | | | | 116 | None |
| 8 | 0.206 | | | | 0.0034 | 0.0086 | | 0.0031 | 1.872 | | 0.0032 | 137 | None |
| 9 | 0.342 | | | | 0.0006 | | | | 0.376 | | | 124 | None |
| 10 | 0.223 | | | 0.0014 | 0.0041 | | | 0.0138 | | 1.261 | | 134 | None |
| 11 | | 0.047 | | | 0.0030 | | | | | | | 123 | None |
| 12 | | 0.231 | | | 0.0011 | | | | | 0.492 | | 130 | None |
| 13 | | 0.313 | 0.0023 | 0.0010 | 0.0016 | | | | | | | 135 | None |
| 14 | | 0.306 | | | 0.0045 | | | | | 1.675 | | 117 | None |
| 15 | | 0.314 | | | 0.0036 | | | | 1.835 | | | 125 | None |
| 16 | | 0.319 | | | 0.0007 | | | | | | 0.0035 | 133 | None |
| 17 | | 0.172 | | | | | | 0.0122 | 1.972 | 0.510 | | 112 | None |
| 18 | | 0.033 | | | | | | | | | | 122 | None |
| 19 | 0.396 | | | 0.0010 | | | | | | | | 120 | None |
| 20 | 0.369 | | | | 0.0014 | 0.0018 | 0.0194 | | | | | 107 | None |
| 21 | | 0.315 | | | | | | | | | | 135 | None |
| 22 | 0.178 | | 0.0048 | | | | | | | 0.523 | | 124 | None |
| 23 | | 0.460 | | | | | | | | | | 129 | None |
| 24 | 0.041 | 0.487 | | | | | | | | | | 118 | None |
| 25 | 0.388 | 0.017 | | 0.0018 | | | | | | | | 111 | None |
| 26 | 0.086 | 0.121 | | | | | | 0.0162 | | | | 108 | None |
| 27 | 0.395 | 0.365 | | | | 0.0011 | | | | | | 128 | None |
| 28 | 0.340 | 0.230 | 0.0026 | | | | 0.0014 | | | | | 116 | None |
| 29 | 0.361 | 0.435 | | 0.0013 | | | | | 1.272 | | | 106 | None |
| 30 | 0.463 | | | | 0.0006 | | | | | 0.966 | | 139 | None |
| 31 | 0.380 | | | | 0.0019 | | | | | | | 121 | None |
| 32 | 0.095 | | 0.0044 | 0.0008 | | | | | | | | 105 | None |
| 33 | 0.254 | | 0.0012 | | | | | | | | 0.0027 | 131 | None |
| 34 | 0.195 | | 0.0012 | | | | | 0.0017 | | | 0.0031 | 127 | None |
| 35 | 0.390 | | 0.0042 | | | 0.0016 | | | | | 0.0047 | 110 | None |
| 36 | 0.033 | | 0.0018 | | | | | | | | 0.0052 | 130 | None |
| 37 | 0.253 | | | 0.0004 | | | | | 1.935 | | 0.0056 | 111 | None |
| 38 | 0.403 | 0.397 | | | | | 0.0099 | | | | | 115 | None |
| 39 | 0.168 | 0.411 | | 0.0004 | | | | | 1.304 | | | 129 | None |
| 40 | 0.415 | 0.200 | | | | | 0.0107 | | 1.649 | | | 139 | None |

TABLE 1-continued

| | | | | | | | | | | | | | |
|---|---|---|---|---|---|---|---|---|---|---|---|---|---|
| Inventive Steels | | | | | | | | | | | | | |
| 41 | | 0.474 | | | | | | | 1.696 | 0.542 | | 125 | None |
| 42 | 0.450 | 0.201 | | | | | | | 1.824 | | | 111 | None |
| 43 | | 0.407 | | | | | | | 1.651 | | | 125 | None |
| 44 | 0.056 | | | | 0.0010 | | | | 0.963 | | | 108 | None |
| 45 | 0.182 | | | 0.0007 | | | | | 0.444 | | | 123 | None |
| 46 | 0.353 | | | | 0.0008 | 0.0004 | | | 1.380 | | 0.0009 | 138 | None |
| 47 | 0.040 | | | | | 0.0003 | 0.0118 | | 1.553 | | | 128 | None |
| 48 | 0.272 | | | | | 0.0007 | | | 1.683 | | 0.0081 | 134 | None |
| 49 | 0.494 | | | 0.0004 | | | | | 1.198 | | | 135 | None |
| 50 | 0.073 | | | | 0.0005 | | | | 1.302 | 0.803 | | 129 | None |
| 51 | 0.339 | 0.141 | | 0.0017 | | | | | 0.245 | | | 130 | None |
| 52 | 0.498 | | | | | 0.0005 | | | 1.368 | | | 106 | None |
| 53 | 0.008 | | | 0.0018 | | | | | 1.156 | | | 129 | None |
| 54 | 0.243 | 0.055 | | | | | | 0.0115 | 0.585 | | | 120 | None |
| 55 | 0.323 | | | | | 0.0006 | 0.0022 | | 1.010 | | | 136 | None |
| 56 | 0.426 | | | | 0.0042 | | | | 1.623 | | 0.0020 | 126 | None |
| 57 | 0.013 | | | | | 0.0016 | | | 0.875 | | | 124 | None |
| 58 | 0.223 | 0.047 | | | | 0.0012 | | | 1.333 | 0.408 | | 105 | None |
| 59 | 0.117 | | | 0.0006 | | 0.0010 | | | 1.745 | | | 107 | None |
| 60 | 0.260 | | | | | 0.0019 | | 0.0142 | 0.319 | | | 119 | None |
| 61 | 0.269 | 0.185 | | | | 0.0015 | | | 0.331 | | | 121 | None |
| 62 | 0.379 | | | | | 0.0018 | | 0.0071 | 1.377 | | | 121 | None |
| 63 | 0.459 | | | | | 0.0004 | | | 0.939 | | 0.0048 | 114 | None |
| 64 | 0.445 | | | | 0.0006 | | | 0.0162 | | | | 117 | None |
| 65 | 0.427 | | | | | 0.0006 | 0.0030 | | | | 0.0064 | 136 | None |
| 66 | 0.455 | | | 0.0012 | | | | | | | | 132 | None |
| 67 | 0.458 | | | | 0.0004 | | | | | 1.940 | 0.0009 | 133 | None |
| 68 | 0.043 | | | | | 0.0006 | | | | | | 127 | None |
| 69 | 0.186 | | | | 0.0010 | | | | | 0.170 | | 106 | None |
| 70 | 0.300 | | | | 0.0009 | | | | | 1.708 | | 111 | None |
| 71 | 0.273 | | | | 0.0016 | | | | | 1.617 | | 115 | None |
| 72 | 0.050 | | | | 0.0017 | | | 0.0156 | | 1.709 | | 121 | None |
| 73 | 0.084 | | 0.0010 | | 0.0011 | | | | | 0.828 | | 117 | None |
| 74 | 0.334 | | 0.0012 | 0.0010 | 0.0009 | | 0.0104 | | | 1.631 | | 123 | None |
| 75 | 0.455 | | 0.0035 | | 0.0020 | | | | | 0.720 | | 109 | None |
| 76 | 0.182 | | 0.0048 | | 0.0009 | | | | | | | 118 | None |
| 77 | 0.020 | | 0.0019 | | 0.0014 | | | | | | | 123 | None |
| 78 | 0.294 | | | | 0.0015 | | | 0.0065 | | | 0.0060 | 123 | None |
| 79 | 0.334 | | | 0.0006 | 0.0008 | | | | | | 0.0045 | 136 | None |
| 80 | 0.156 | | | 0.0016 | 0.0011 | | | | | | | 122 | None |
| 81 | 0.150 | | | | 0.0019 | | 0.0057 | | | | | 136 | None |
| 82 | | 0.005 | | | 0.0007 | | | | | | | 131 | None |
| 83 | | 0.390 | | | 0.0006 | | | | | 1.132 | | 135 | None |
| 84 | | 0.132 | | | | 0.0019 | | | | | | 133 | None |
| 85 | | 0.424 | 0.0039 | | | | | | | | 0.0064 | 106 | None |
| 86 | | 0.238 | | | | 0.0015 | | | | | | 127 | None |
| 87 | | 0.179 | | | | 0.0014 | | | 0.272 | | 0.0017 | 119 | None |
| 88 | | 0.335 | | | | 0.0012 | | | 0.292 | | | 116 | None |
| 89 | | 0.049 | | | | 0.0019 | | 0.0031 | 0.782 | | | 117 | None |
| 90 | | 0.251 | | | | 0.0003 | 0.0024 | | 0.387 | | | 109 | None |
| 91 | | 0.205 | | 0.0019 | | | | | 0.872 | | | 115 | None |
| 92 | | 0.087 | | | | 0.0006 | | | 1.955 | | | 124 | None |
| 93 | | 0.492 | | 0.0016 | | | | | 1.327 | 0.842 | | 124 | None |
| 94 | | 0.114 | 0.0028 | | | | | | 1.666 | | 0.0014 | 115 | None |
| 95 | | 0.346 | | | | | 0.0157 | | 0.413 | | | 134 | None |
| 96 | | 0.168 | | 0.0013 | | | | | 0.205 | | | 112 | None |
| 97 | | 0.093 | | | | | | 0.0151 | 1.291 | | 0.0022 | 121 | None |

CRS: $10^5$-hr linear-extrapolated rupture strength at 650° C. estimated by linear extrapolation of the measurements of $10^4$-hr creep rupture strength at 650° C..

Intermetallic compound: Results of identification of an intermetallic compound substantially having a composition of $Cr_{40}Mo_{20}Co_{20}W_{10}C_2$-Fe by X-ray diffractometry and observation under an electron microscope. When other intermetallic compound has been observed, indication "Observed" is placed together with the name of the compound.

TABLE 2

| | | | | | | | | | | | | | |
|---|---|---|---|---|---|---|---|---|---|---|---|---|---|
| Comparative Steels | | | | | | | | | | | | | |
| No. | C | Si | Mn | P | S | Cr | Mo | W | Co | Nb | V | N | O |
| 98 | 0.066 | 0.175 | 0.382 | 0.0090 | 0.0091 | 10.848 | 0.220 | 3.126 | 1.413 | 0.474 | 0.129 | 0.0024 | 0.0125 |
| 99 | 0.038 | 0.258 | 1.308 | 0.0025 | 0.0089 | 9.763 | 0.111 | 2.462 | 0.805 | 0.424 | 0.687 | 0.0319 | 0.0136 |
| 100 | 0.161 | 0.522 | 0.315 | 0.0228 | 0.0033 | 10.092 | 0.245 | 1.137 | 5.662 | 0.177 | 0.134 | 0.0795 | 0.0143 |
| 101 | 0.188 | 0.756 | 0.601 | 0.0131 | 0.0043 | 8.548 | 0.163 | 1.101 | 5.671 | 0.177 | 0.142 | 0.1331 | 0.0177 |
| 102 | 0.161 | 0.197 | 1.178 | 0.0048 | 0.0059 | 10.106 | 0.267 | 0.171 | 1.811 | 0.056 | 0.195 | 0.1420 | 0.0159 |
| 103 | 0.027 | 0.742 | 0.844 | 0.0222 | 0.0081 | 9.043 | 0.251 | 1.831 | 2.642 | 0.138 | 0.464 | 0.1422 | 0.0118 |

TABLE 2-continued

| | | | | | | | | | | | | | |
|---|---|---|---|---|---|---|---|---|---|---|---|---|---|
| Comparative Steels | | | | | | | | | | | | | |
| 104 | 0.067 | 0.789 | 0.378 | 0.0299 | 0.0052 | 10.706 | 0.227 | 1.681 | 4.542 | 0.068 | 0.639 | 0.0902 | 0.0183 |
| 105 | 0.128 | 0.028 | 0.295 | 0.0274 | 0.0061 | 8.125 | 0.091 | 4.439 | 0.270 | 0.287 | 0.519 | 0.0830 | 0.0187 |
| 106 | 0.133 | 0.486 | 0.245 | 0.0179 | 0.0003 | 9.049 | 0.068 | 4.326 | 2.180 | 0.234 | 0.295 | 0.1782 | 0.0134 |
| 107 | 0.145 | 0.146 | 0.446 | 0.0266 | 0.0020 | 11.368 | 0.187 | 2.874 | 5.482 | 0.198 | 0.309 | 0.0536 | 0.0084 |
| 108 | 0.028 | 0.035 | 1.124 | 0.0268 | 0.0061 | 9.115 | 0.231 | 2.664 | 2.263 | 0.357 | 0.408 | 0.1203 | 0.0055 |
| 109 | 0.125 | 0.267 | 1.097 | 0.0132 | 0.0036 | 10.759 | 0.233 | | 5.161 | 0.256 | 0.630 | 0.1974 | 0.0038 |
| 110 | 0.279 | 0.048 | 1.070 | 0.0157 | 0.0055 | 11.190 | 0.228 | 7.180 | 0.433 | 0.118 | 0.067 | 0.1397 | 0.0171 |
| 111 | 0.282 | 0.588 | 0.207 | 0.0050 | 0.0019 | 8.074 | 0.087 | 0.334 | 0.003 | 0.059 | 0.733 | 0.1337 | 0.0173 |
| 112 | 0.297 | 0.587 | 1.367 | 0.0074 | 0.0057 | 10.712 | 0.186 | 4.897 | 8.160 | 0.022 | 0.175 | 0.1312 | 0.0092 |

| No. | Ti | Zr | Ca | Ba | Mg | Y | Ce | La | Ni | Cu | B | CRS | Intermetallic compounds |
|---|---|---|---|---|---|---|---|---|---|---|---|---|---|
| 98 | | | 0.0045 | 0.0015 | 0.0044 | 0.0152 | 0.0013 | 0.0083 | 1.325 | 0.852 | 0.0031 | 81 | Observed |
| 99 | | | | | | | 0.0019 | | | | | 62 | Observed |
| 100 | 0.622 | | | | | | 0.0192 | | | | | 90 | None |
| 101 | | 0.715 | | 0.0013 | | | 0.0029 | | 0.597 | | | 68 | None |
| 102 | 0.793 | 0.556 | 0.0006 | | | | | | | | 0.0037 | 61 | None |
| 103 | 0.140 | 0.435 | | | | | | | 1.840 | | 0.0028 | 90 | Observed |
| 104 | 0.031 | | | | | | | | | | | 71 | Observed |
| 105 | 0.284 | | 0.0082 | | 0.0026 | 0.0129 | | 0.0133 | 0.578 | | 0.0035 | 71 | None |
| 106 | 0.029 | | | | 0.0091 | | | | 1.604 | | | 65 | None |
| 107 | 0.262 | | | 0.0011 | 0.0038 | 0.0311 | | 0.0138 | | 0.465 | | 89 | None |
| 108 | | 0.325 | | | 0.0020 | | 0.0220 | | | | | 82 | None |
| 109 | | 0.281 | | | 0.0017 | | | | | 1.602 | | 68 | None |
| 110 | | 0.042 | 0.0032 | 0.0005 | 0.0015 | | | | | | | 88 | Observed ($Fe_2W$) |
| 111 | | 0.323 | | | 0.0047 | | | | | 1.358 | | 80 | None |
| 112 | | 0.171 | | | 0.0048 | | | | | | | 75 | Observed ($Fe_2Co$) |

CRS: $10^5$-hr linear-extrapolated rupture strength at 650° C. estimated by linear extrapolation of the measurements of $10^4$-hr creep rupture strength at 650° C..

Intermetallic compound: Results of identification of an intermetallic compound substantially having a composition of $Cr_{40}Mo_{20}Co_{20}W_{10}C_2$-Fe by X-ray diffractometry and observation under an electron microscope. When other intermetallic compound has been observed, indication "Observed" is placed together with the name of the compound.

INDUSTRIAL APPLICABILITY

A martensitic heat resistant steel is provided which has improved high temperature creep strength, contains Co and, at a temperature of 600° C. or above, does not form an intermetallic compound substantially having a composition of $Cr_{40}Mo_{20}Co_{20}W_{10}C_2$—Fe.

We claim:

1. A high strength, ferritic heat resistant steel having improved resistance to intermetallic compound precipitation-induced embrittlement, characterized by comprising, by mass:

C: 0.01 to 0.30%,

Si: 0.01 to 0.80%,

Mn: 0.20 to 1.50%,

Cr: 8.00 to 13.00%,

Mo: 0.01 to 3.00%,

W: 0.10 to 5.00%,

Co: 0.05 to 6.00%,

V: 0.002 to 0.800%,

Nb: 0.002 to 0.500%, and

N: 0.002 to 0.200% and at least one additional element selected from

Ca: 0.0005 to 0.0050%,

Ba: 0.0003 to 0.0020%,

Mg: 0.0005 to 0.0050%,

La: 0.001 to 0.020%,

Ce: 0.001 to 0.020%, and

Y: 0.001 to 0.020%, said Ca, Ba, and Mg being contained as precipitate, said La, Ce, and Y being contained as precipitate or in solid solution, said steel further comprising one of or a combination of Ti: 0.002 to 0.500% and Zr: 0.002 to 0.500, said steel having P, S, and O contents limited to P: not more than 0.030%, S: not more than 0.010%, and O: not more than 0.020%, with the balance consisting of Fe and unavoidable impurities.

2. The high strength, ferritic heat resistant steel having improved resistance to intermetallic compound precipitation-induced embrittlement according to claim 1, characterized by further comprising, by mass, at least one member selected from:

Ni: 0.10 to 2.00% and

Cu: 0.10 to 2.00%.

3. The high strength, ferritic heat resistant steel having improved resistance to intermetallic compound precipitation-induced embrittlement according to claim 1, characterized by further comprising, by mass:

B: 0.0005 to 0.010%.

4. The high strength, ferritic heat resistant steel having improved resistance to intermetallic compound precipitation-induced embrittlement according to claim 2, characterized by further comprising, by mass:

B: 0.0005 to 0.010%.

* * * * *

UNITED STATES PATENT AND TRADEMARK OFFICE

CERTIFICATE OF CORRECTION

PATENT NO. : 5,772,956

DATED : June 30, 1998

INVENTOR(S) : Yasushi HASEGAWA, et al.

It is certified that error appears in the above-indentified patent and that said Letters Patent is hereby corrected as shown below:

ABSTRACT, line 8, after "small" insert --amount--.

Column 2, line 52, delete "an" before "about".

Column 4, line 25, change "0.30." to --0.30%.--.

Column 5, line 29, change "0.800." to --0.800%.--.

Column 6, line 25, change "element" to --elements--.

Column 7, line 33, change "element" to --elements--.

Column 8, line 41, change "all step" to --all steps--.

Column 10, line 19, change "are" to --is--.

Column 10, line 34, change "liner-extrapolated" to --linear-extrapolated--.

Column 10, line 67-column 11, line 1, change "toughnesses" to --toughnesses--.

UNITED STATES PATENT AND TRADEMARK OFFICE

CERTIFICATE OF CORRECTION

PATENT NO. : 5,772,956

DATED : June 30, 1998

INVENTOR(S) : Yasushi HASEGAWA, et al.

It is certified that error appears in the above-indentified patent and that said Letters Patent is hereby corrected as shown below:

Columns 17 and 18, line number 112, under column headed "Ni", insert --1.866--.

Column 18, line 37, change "0.500," to --0.500%.--.

Signed and Sealed this

Seventeenth Day of October, 2000

*Attest:*

Q. TODD DICKINSON

*Attesting Officer*

*Director of Patents and Trademarks*